US005347782A

United States Patent [19]

Vagedes

[11] Patent Number: 5,347,782

[45] Date of Patent: Sep. 20, 1994

[54] SHUTTER ASSEMBLY

[75] Inventor: Michael Vagedes, Florence, Ky.

[73] Assignee: Richwood Building Products, Inc., Richwood, Ky.

[21] Appl. No.: 60,316

[22] Filed: May 11, 1993

[51] Int. Cl.[5] ..... E06B 7/08

[52] U.S. Cl. ..... 52/473

[58] Field of Search ..... 49/74.1; 52/473, 829; 403/298

[56] References Cited

U.S. PATENT DOCUMENTS

| | | | |
|---|---|---|---|
| Re. 18,077 | 5/1931 | Larson | 52/829 X |
| 3,191,242 | 6/1965 | Rauen . | |
| 3,394,518 | 7/1968 | Worrell | 52/473 |
| 3,455,079 | 7/1969 | Frederick . | |
| 3,527,486 | 9/1970 | Gamp | 403/298 X |
| 3,797,186 | 3/1974 | Smith . | |
| 3,968,738 | 7/1976 | Matzke . | |
| 4,251,966 | 2/1981 | Foltman . | |
| 4,765,110 | 8/1988 | MacLeod . | |
| 4,858,400 | 8/1989 | Foyt . | |
| 5,060,442 | 10/1991 | Chubb | 52/473 |
| 5,152,116 | 10/1992 | MacGowan . | |

*Primary Examiner*—Peter M. Cuomo
*Assistant Examiner*—Jerry Redman
*Attorney, Agent, or Firm*—Wood, Herron & Evans

[57] ABSTRACT

A shutter assembly is provided which includes a body portion and separate top and bottom caps. The length of the shutter is adjusted by sliding the caps so they cover more or less of the shutter body. The caps and body portion are then screwed to a building wall. The length of the shutter assembly can also be adjusted by cutting upper and lower portions of this body portion of the shutter. The cut is then covered by preformed caps which fit over the shutter body portion, thus totally concealing the cut. Thus, the shutter can be adjusted at the job site and the end caps will assure the quality of the end product.

8 Claims, 3 Drawing Sheets

SHUTTER ASSEMBLY

BACKGROUND OF THE INVENTION

Most shutters which are now used with homes serve only an ornamental function. As such, most of these are formed by injection molding using colored plastic to permit formation of a plastic shutter which does not rot and generally does not require painting. Distributors simply stock shutters of different colors so that he can supply them to their customers.

In addition to a variety of a number of different colors, there are also a number of different sizes. Windows come in many different lengths and as such the shutter must correspond in size to the length of the window. Thus, the distributor must not only stock different colors but must stock different sizes, frequently ten to fifteen different sizes. The problem created by this is quite obvious. The stocking requirements are prohibitive for many distributors.

To overcome this problem, plastic shutters have been formed which can be adjusted in size. Several of these are disclosed in U.S. Pat. Nos. 5,152,116, 4,765,110, 3,455,079 and 4,251,966.

The problem with each of these designs is that the adjustment is too complex. Generally, the adjustment must be made by the distributor as opposed to the end user due to the complexity of the adjustment. Precise cuts are required plus assembly using various fasteners, plastic rivets and the like. This is totally unacceptable if one wishes to adjust the size of the shutter at the job site. Further, due to the large number of separate components, these shutters rattle and can easily fall apart.

SUMMARY OF THE INVENTION

Accordingly, it is an object of the present invention to provide a shutter which can be shortened easily and simply, permitting adjustment at the job site.

It is also an object of the present invention to provide such an adjustable shutter which can be cut to size easily, if desired, and quickly assembled and installed.

The objects and advantages of the present invention are obtained by providing a shutter which has a body portion without a fixed top or bottom end cap. The body portion is one molded piece including the stiles, mullion and slats. A portion of the top and bottom of the body portion can be cut to size. The ends are then covered with preformed end caps. The shutter is assembled by screwing through the end cap and through the body portion into the house, assembling the shutter and attaching it to the house at the same time.

The end cap can slide up or down the body portion providing up to about four inches of adjustment without cutting the body portion.

The objects and advantages of the present invention will be further appreciated in light of the following detailed description and drawings in which:

DETAILED DESCRIPTION

Figure 1:
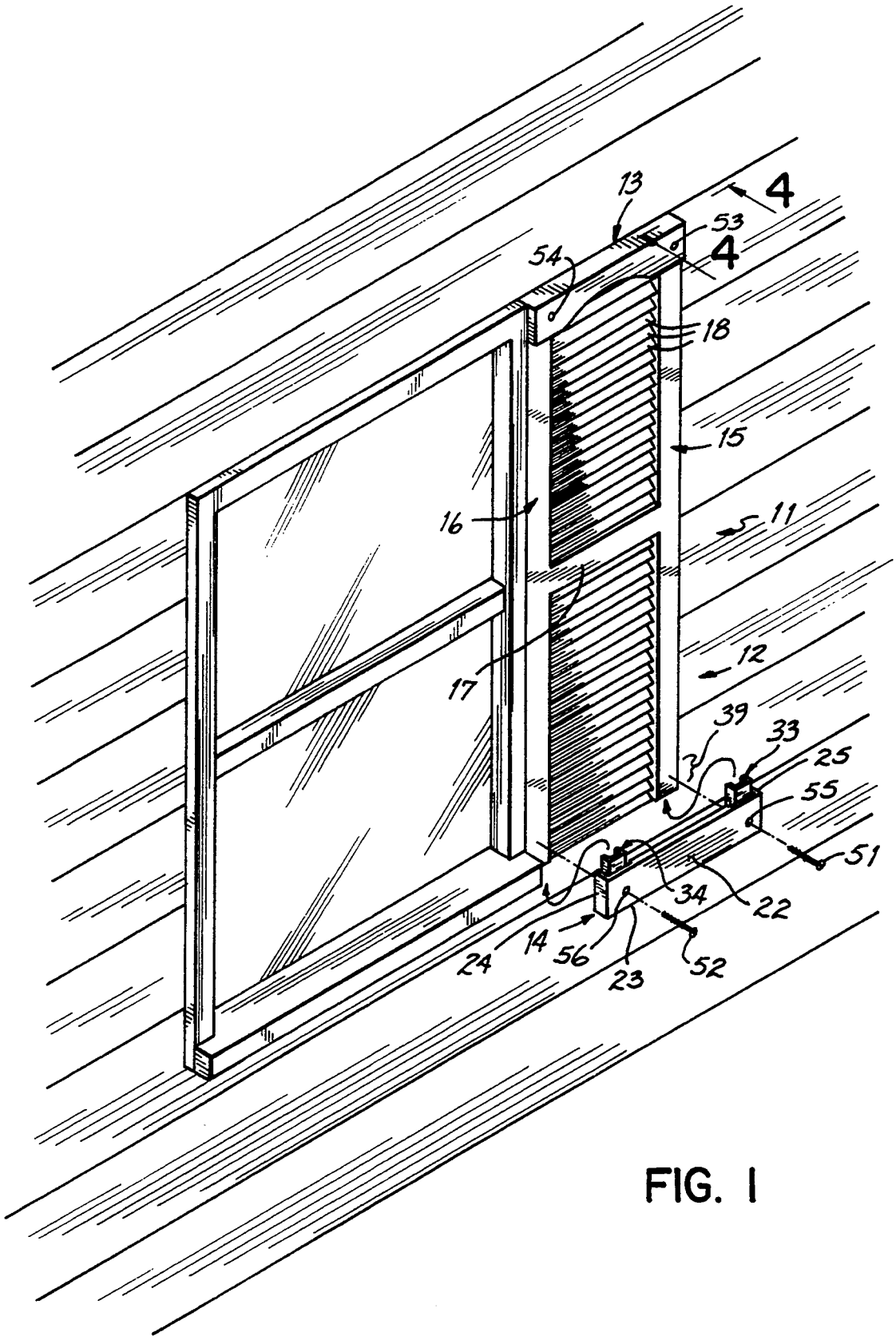
FIG. 1 is a perspective view of an assembled shutter as attached to a building.

The present invention is a plastic shutter assembly 11 preferably injection molded from, for example, polypropylene. As shown in FIG. 1, shutter assembly 11 includes a body portion 12, a top cap 13 and a bottom cap 14. The body portion 12 is formed as with most shutters having a right stile 15 and a left stile 16 parallel to each other. Separating the right stile 15 from the left stile 16 is a central mullion or panel 17. Likewise separating the two stiles are the slats 18 which are separated by spaces 19 therebetween to allow passage of air (see FIG. 3). Running through the central portion of the slats 18 is a vertical brace 21. The brace 21, slats 18, mullion 17 and stiles 15 and 16 are molded as one piece generally with a wall thickness of 0.1 thousandth inch.

Except as noted, bottom cap 14 and top cap 13 are the same and only cap 14 is described in detail Bottom cap 14 includes a front panel 22 which has a horizontal endwall 23 and a first vertical sidewall 24 and a second vertical sidewall 25. Opposite the horizontal endwall 23 is a horizontal lip 26. (The horizontal lip of top cap 13 is curved for ornamental purposes.) The lip 26 does not extend all the way to the first and second vertical walls 24 and 25, but runs short stopping at edges 27 and 28. The distance from edges 27 and 28 to side walls 24 and 25 corresponds in size to the outer width of stiles 15 and 16 respectively. The inside depth of the endwall 23 and first and second sidewalls 24 and 25 are equal to the outside depths of sidewalls 31 and 32 of the right and left stiles 15 and 16 respectively.

Two vertical channels 33 and 34 extend from back wall 23 to about one inch beyond front wall or lip 26. The cross-sections of the channels 33 and 34 correspond to the inside dimensions of stiles 15 and 16. Thus, the channels 33 and 34 are adapted to slide within stiles 15 and 16.

Further, the channels 33 and 34 define areas 37 and 38 between the channels 33 and 34 and the front panel 22 and side walls 24 or 25 of the caps 14 or 13. Areas 37 and 38 are just wide enough to permit the stiles 15 and 16 to snugly slide between the channels 33 and 34 and panel 22 and side walls 24 or 25 respectively. Also, on channels 33 and 34 and stiles 15 and 16 are rows of ridges 40 and 41 which mate with one another as the channels 33 and 34 are engaged with stiles 15 and 16 (see FIGS. 3 and 4). This keeps the end caps in position relative to the shutter body 12 during installation. It also makes it easier to align the left and right sides of caps 13 and 14.

The front panel 22 of cap 14 is at least about 1 inch long (as measured from lip 26 to end wall 23) and preferably 2 to 3 inches long. This provides sufficient area to cover the bottom portion 39 of the shutter body 12 as discussed below and to provide an area for screws to permit assembly of the shutter.

As previously discussed, the invention provides the means to adjust tile length of tho shutters so that they can be used for a variety of different windows. End caps which are three inches long can cover the top and bottom three inches of the shutter or they can cover as little as one inch. Thus, by sliding tile top and bottom caps, the length of the shutter can be adjusted up to four inches.

Figures 2, 3, 4:
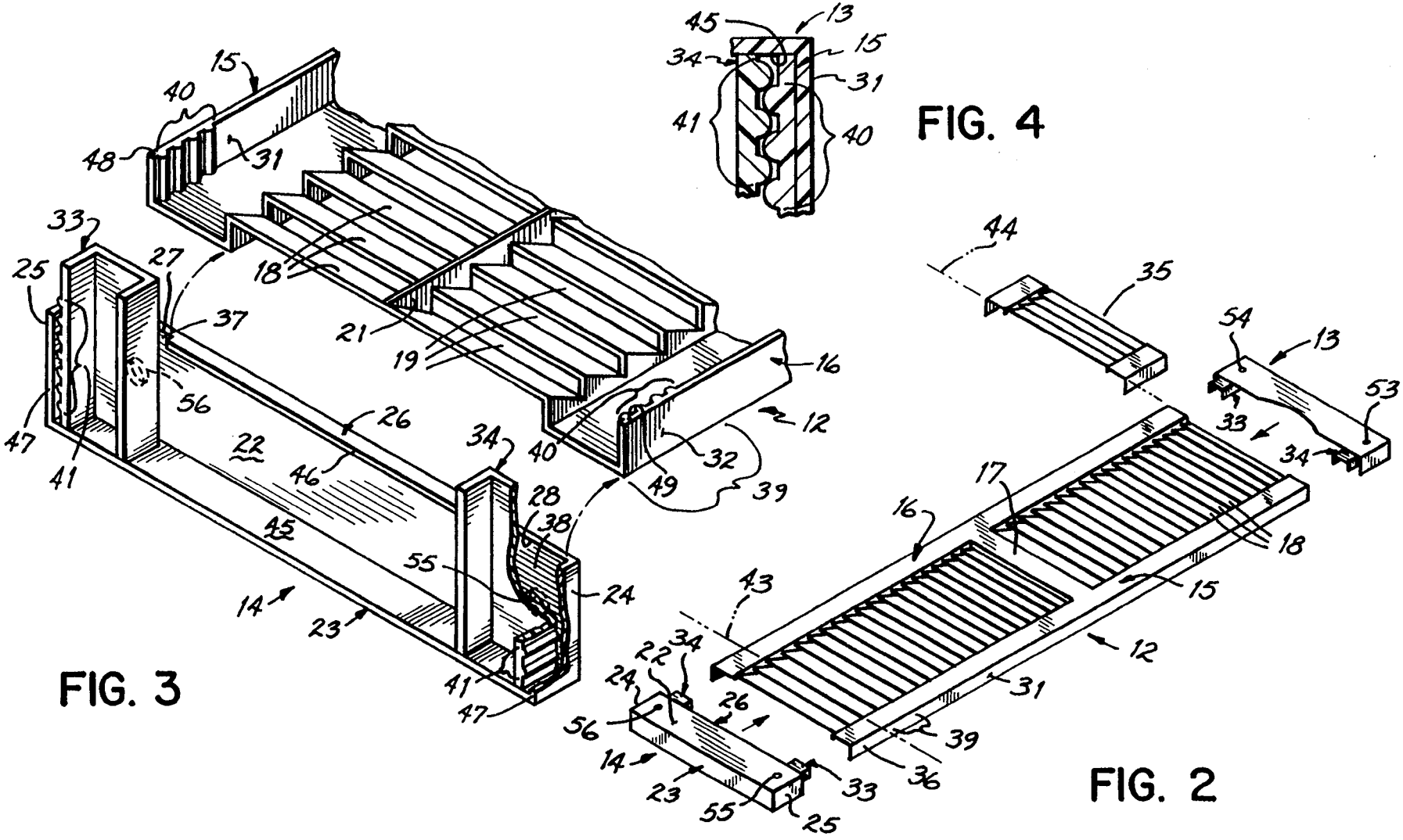
FIG. 2 is a perspective view showing the adjustment of the shutter.
FIG. 3 is a perspective view of a portion of the shutter showing the assembly of the cap onto the shutter body.
FIG. 4 is a cross-sectional view taken at lines 4—4 of FIG. 1.

Alternately, as shown in FIG. 2, the shutter length can be further adjusted by cutting and removing a top portion 35 of the body 12 and a bottom portion 36 of the body 12. By cutting in a straight line (shown as 43 and 44) perpendicular to the stiles 15 and 16 at an area where there is a space 19 between adjacent slats 18, one merely needs to cut the stiles and the central brace to separate a portion 35 or 36 from tile body portion 12. This is shown by cut lines 43 and 44 in FIG. 2.

The end cap 14 is placed over tile ends of the body portion 12. The stiles slide within areas 37 and 38 with the top and bottom of the shutter covered by the front panel 22 of the end cap 14. The ridges 41 on the channels 33 and 34 will engage or mate with the ridges 40 on the walls 31 shown of the stiles. This will temporarily hold the end caps 13 and 14 in position on the shutter body 12.

The lip 26 has a width so that when the stiles rest against the inside surface of the cap, its inside edge 46 will be very close (about ⅛ inch) from the slats. The inside edges 47 of cap 14 will be flush with the inside edges 48 and 49 of sidewalls 31 and 32 of stiles 15 and 16.

The shutter 11 is attached to the side of the house wall by screwing through the panel 22 through left and right stiles 15 and 16 and channels 33 and 34 into the wall. This will be done with both the top and bottom caps so that four screws 51, 52, 53 and 54 are fastened through the caps 13 and 14 and stiles and into the wall holding the shutter assembly together and fastened to the building wall as shown.

As shown in FIGS. 2 and 3, caps 13 and 14 may include preformed holes 55, 56, 57, and 58 through panel 22 to assist in assembly. With the caps 13 and 14 on the body portion 12, holes can be drilled through the stiles using the holes 55–58 in the caps 13 and 14 as guides. The channels 33 and 34 provide stability to the assembled shutter making sure that caps are properly aligned with the shutter body.

Figure 5:
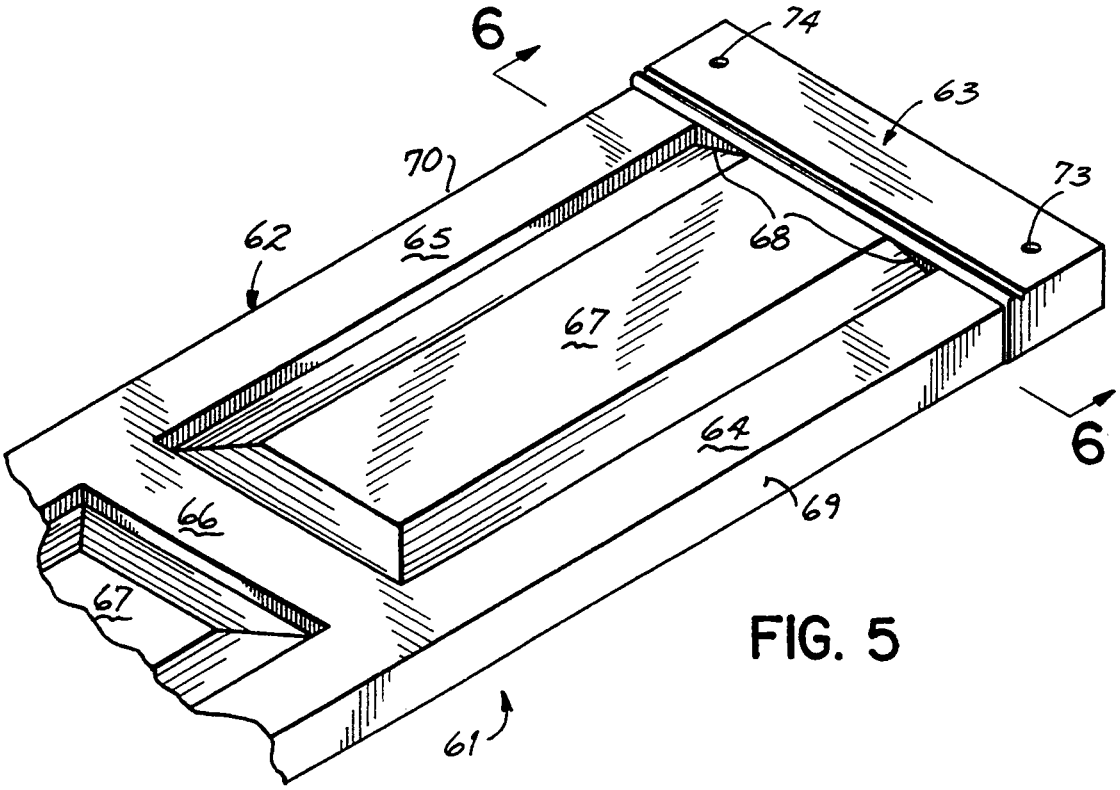
FIG. 5 is a perspective view of an alternate embodiment of the present invention.
Figure 6:
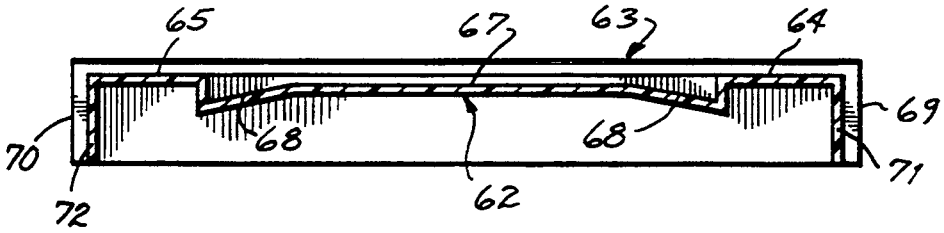
FIG. 6 is a cross-sectional view taken at lines 6—6 of FIG. 5.

An alternate embodiment of the present invention is shown in FIGS. 5 and 6. In this embodiment, the shutter assembly 61 includes a body portion 62 and a cap 63. Only the top portion of the shutter 61 is shown. However, the bottom portion of the shutter is a mirror image of the top portion. The body portion 62 likewise includes first and second stile, 64 and 65, and mullion 66. Between stiles 64 and 65 are raised panels 67. The presence of the raised panel 67 requires a modification of the end cap to facilitate conforming to its cross-sectional configuration. Accordingly, cap 63 has an edge 68 which corresponds to the cross-sectional configuration of the body portion as taken at line 6—6 and shown in FIG. 6. The cap portion 63 itself also has side walls 69 and 70 whose inside depth is the same depth as the outside depth of the walls 71 and 72 of stiles 64 and 65.

As with the first embodiment, the shutter assembly 61 can be adjusted as to size by simply cutting from the top and bottom of the shutter 61 and placing the cap 63 and a bottom cap (not shown) to cover the cut portion. Screws can then be inserted through holes 73 and 74 to hold the shutter assembly together mounted to a building wall.

Thus, by using this method one merely needs to stock the cap portions and one size of the body portion. In order to avoid waste, one may want to have three separate sizes of body portions so that excessive amounts of the body portion need not be cut away and discarded. But, in any event, this significantly reduces the stock that must be maintained in order to have shutters which can be used for any different size window.

Since the end cap fits over the top and bottom portions which have been cut, one does not have to have perfectly mitered cuts. Plastic graining can be provided along the stiles and horizontally along the end caps to provide the appearance of natural wood. These products are strong, durable and aesthetically appealing as well as practical and simple.

This has been a description of the present invention along with the preferred method of practicing the present invention.

However, the present invention should be defined only by the appended claims wherein I claim:

1. A shutter assembly comprising a body portion;

an upper cap; and a lower cap;

said body portion having an upper and lower portion and two parallel lateral stiles said upper portion having a front surface and an upper edge and two lateral sides, said lower portion having a front surface and a lower edge and two lateral sides;

wherein said upper and lower caps are fitted over said upper portion and lower portion respectively; said upper cap covering said upper edge, said lateral sides and said front surface of said upper portion and thereby permitting the length of said shutter to be adjusted by covering a selected length of said front portion and said lower cap covering said lower edge and said lateral sides and said front surface of said lower portion thereby permitting the length of the shutter to be adjusted by covering a selected length of said front portion.

2. The shutter assembly claimed in claim 1 wherein said upper and lower caps each include two channels adapted to slide within said stiles, and two areas between said channels and body panels of said upper and lower caps adapted to permit said stiles to slide within said areas.

3. The shutter assembly claimed in claim 2 wherein said channels each include a plurality of spaced ridges adapted to mate with a plurality of ridges on an inside surface of said stiles.

4. The shutter assembly claimed in claim 1 wherein said body portion includes a plurality of slats extending between said stiles and wherein said slats are separated from each other by open areas with a central brace connecting said adjacent slats whereby said body portion can be shortened by only cutting each of said stiles and said brace in a straight line perpendicular to said stiles to shorten said body portion and thereby shorten said shutter assembly.

5. The shutter assembly claimed in claim 1 wherein said body portion includes two raised panel portions extending between said stiles and wherein said end caps have a lower edge having a configuration complementary to a cross-section of said raised panel portions.

6. A shutter assembly comprising a body portion, an upper cap and a lower cap, said body portion having an upper and lower portion and two parallel, lateral stiles;

wherein said upper cap and lower cap each comprise a body panel, a horizontal end wall and two opposed lateral walls wherein said lateral walls are spaced to fit over said two stiles of said body portion with said body panels of said upper and lower caps covering said upper and lower portions;

wherein said body portion includes a plurality of slats extending between said stiles and wherein said slats are separated from each other by open areas with a central brace connecting said adjacent slats whereby said body portion can be shortened by only cutting each of said stiles and said brace in a straight line perpendicular to said stiles to shorten said body portion and thereby shorten said shutter assembly.

7. A shutter assembly comprising a body portion, an upper cap and a lower cap;

said body portion having an upper and lower portion and two parallel lateral stiles;

wherein said caps each comprise a body panel, a horizontal end wall and two lateral walls wherein said lateral walls are spaced to fit over said two stiles of said body portion with said body panels of said upper and lower caps covering said upper and lower portions;

wherein said upper and lower caps each include two channels adapted to slide within said stiles and two areas between said channels and said body panels of said upper and lower caps adapted to permit said stiles to slide within said areas;

wherein said stiles have an inside surface and said inside surface of said stiles each including a plurality of spaced ridges and wherein said channels each include a plurality of spaced ridges adapted to mate with said plurality of ridges on said inside surface of said styles.

8. A shutter assembly comprising a body portion and an upper cap, said body portion having an upper portion, said upper portion having an upper edge, two lateral sidewalls and a front panel and a rear section; said upper cap covering said upper edge, said two lateral sidewalls and said front panel; said upper cap further engaging said rear section and permitting said upper portion to snugly slide within said upper cap to define a length of said shutter assembly.

* * * * *